US007621410B1

(12) United States Patent
Updegrove et al.

(10) Patent No.: US 7,621,410 B1
(45) Date of Patent: Nov. 24, 2009

(54) REMOVABLE EXTERNALLY MOUNTED BRIDGE CRANE FOR SHIPPING CONTAINERS

(75) Inventors: Darryl Updegrove, Panama City, FL (US); Garrett W. Leavitt, Panama City Beach, FL (US); James Ellington Sovel, Panama City Beach, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 12/378,583

(22) Filed: Feb. 13, 2009

(51) Int. Cl.
*B66C 23/18* (2006.01)

(52) U.S. Cl. ..... 212/179; 212/270; 414/542

(58) Field of Classification Search ..... 212/179, 212/180, 270; 414/542
See application file for complete search history.

(56) References Cited

U.S. PATENT DOCUMENTS 1,464,131 A * 8/1923 Goodger ..... 414/542
3,006,486 A * 10/1961 Cook et al. ..... 414/542
3,315,825 A * 4/1967 Scheinert ..... 414/542
3,482,715 A * 12/1969 Worthington ..... 414/542
3,482,716 A * 12/1969 Leadley ..... 414/543
3,572,513 A * 3/1971 Tantlinger et al. ..... 212/180
3,578,179 A * 5/1971 Fujioka ..... 212/180
3,811,579 A * 5/1974 Black ..... 414/347
4,705,140 A * 11/1987 Dudley et al. ..... 182/3
4,936,414 A * 6/1990 Rybka ..... 182/2.11
5,028,198 A * 7/1991 Buhr ..... 414/542
5,525,026 A * 6/1996 DeMonte et al. ..... 414/542
5,743,702 A * 4/1998 Gunderson ..... 414/542

* cited by examiner

*Primary Examiner*—Thomas J. Brahan
(74) *Attorney, Agent, or Firm*—James T. Shepherd

(57) ABSTRACT

An X-Y bridge crane can be assembled and erected by workmen to lift and move loads at the end of a shipping and stowage container having block-shaped corner fittings at top corners and bottom corners. Rotatable top securing brackets engage the top block-shaped corner fittings and rotatable bottom securing brackets engage the bottom block-shaped corner fittings. Inner end portions of brace members are rotatably connected to the rotatable bottom securing brackets. A framework having inner extensions, outer projecting parts and a laterally extending hoist-traveling beam has inner extensions connected to the top securing brackets and outer projecting parts connected to the outer end portions of the brace members. A hoist is mounted on the hoist-traveling beam to lift and move loads on the framework, and first and second chainfalls connected to the hoist linearly displace the hoist in orthogonal directions.

10 Claims, 4 Drawing Sheets

REMOVABLE EXTERNALLY MOUNTED BRIDGE CRANE FOR SHIPPING CONTAINERS

STATEMENT OF GOVERNMENT INTEREST

The invention described herein may be manufactured and used by or for the Government of the United States of America without the payment of any royalties thereon or therefor.

BACKGROUND OF THE INVENTION

This invention relates to a crane mounted on a shipping and stowage container. More particularly, this invention is for a self-erecting crane secured to the end of a shipping and stowage container using powered hoists for lifting/lowering loads and manual force for extending/retracting the lifted loads in the X-direction and transversally moving the loads in the Y-direction.

Containers are widely used in air, sea and land transport of goods since they keep many items together as a lot and protect them from damage during the haul. Large transport vehicles can carry rows and columns of the containers that can rest singly or in stacks on decks and/or pallets.

The great majority of shipping and stowage containers in commercial air and maritime commerce have evolved into a standard design. The standard established by ISO 1161 requirements by the International Organization for Standardization defines containers of standardized dimensions and ruggedness to promote efficiency and safety for air and maritime use. The ISO 1161 containers are robustly constructed with rigid side walls mounted on strong frameworks that have a heavy-duty block-shaped corner fitting at each of the containers' eight corners. The corner fittings and other parts of an ISO 1161 container can be made of steel, aluminum or other tough material.

The block-shaped corner fittings have outward facing elongated openings sized to receive appropriately dimensioned heavy-duty rotatable bayonet portions of standard double-cone twist-lock fittings. When a cone-shaped bayonet portion of a double-cone twist lock fitting is inserted through an opening and into an ISO 1161 corner fitting, the inserted portion is manually rotated a partial turn via an attached small twist-lock lever. This rotation of the inserted bayonet portion securely engages the twist-lock fitting to the block-shaped corner fitting, and when the other cone-shaped bayonet portion of the double-cone twist lock fitting is inserted through an opening and into a piece that needs to be interconnected, the other inserted portion is manually rotated a partial turn via an attached small twist-lock lever to secure the piece to the container. A considerable number of ISO 1161 block-shaped corner fittings are well known and commercially available, and interfacing standard double-cone twist-lock fittings are well known and commercially available by a number of well known suppliers, such as the Model AE10000A-1GA Double Cone Two Position Twistloc with "Preloc" feature marketed by TANDEMLOC Inc., 824 Highway 101, Havelock, N.C. 28532, and the F476, F633, F656 series of twist locks by Peck and Hale Cargo Securing Systems, 189 Division Avenue, West Sayville, N.Y. 11796.

Frequently the need arises for strong lifting mechanisms at containers to help in the performance of work tasks adjacent the containers or to help load/unload goods through one of their several closable openings. Currently, fixed mechanisms that are specifically designed for lifting/relocating items at the containers are not known. Typically, external non-fixed lifting equipment must be brought to the work site at the ends of the containers and utilized to lift/move things. When such non-fixed lifting equipments are available on ships at sea, ship motions may make the use of such forklifts or portable hoists impractical and/or unsafe. In addition, some stowage compartments and holds on ships may have insufficient overhead clearance or capacity to mount an adequate lifting device at the container's ends. Cranes potentially can be mounted internally in the containers, but these might take up too much valuable storage space inside. Additionally, such a crane can have a fixed size and may not be removable or further erectable.

Thus, in accordance with this inventive concept, a need has been recognized in the state of the art for a crane externally mounted on a shipping and stowage container for lifting/lowering loads, and extending/retracting lifted loads in the X-direction and transversally moving lifted loads in the Y-direction.

SUMMARY OF THE INVENTION

The present invention provides a readily assembled and installed X-Y bridge crane for lifting and moving loads at the end of a shipping and stowage container having block-shaped corner fittings at top corners and bottom corners at its end. Rotatable top securing brackets engage the top block-shaped corner fittings, and rotatable bottom securing brackets engage the bottom block-shaped corner fittings. A pair of elongate brace members has inner and outer end portions, and the inner end portions are rotatably connected to the rotatable bottom securing brackets. A rectangular framework has inner extensions, outer projecting parts, and a laterally extending hoist-traveling beam. The inner extensions are connected to the top securing brackets and the outer projecting parts of the framework are connected to the outer end portions of the elongate brace members. A hoist is mounted on the hoist-traveling beam for lifting and moving loads on the framework and first and second displacement mechanisms are connected to the hoist to linearly displace it in orthogonal X and Y directions. The framework includes a pair of longitudinal members extending in the X-direction connected to a pair of lateral members extending in the Y-direction. A pair of cable braces are each connected at opposite ends to upward projecting parts at the ends of each of the longitudinal members at the four corners of the framework. The cable braces diagonally extend above and across the framework in a mutually crossing relationship to further strengthen it to bear and transfer loads reliably. Multi-wheeled roller assemblies mounted on opposite ends of the hoist traveling beam support and allow the hoist traveling beam to ride on the upper surfaces of the longitudinal members between the lateral members of the framework. Installation cables extending from a winch at the container are connected to one of the lateral members. Reeling-in the installation cables by the winch raises the brace members, framework, hoist-traveling beam, and hoist above the ground and draws them toward the end of the container during installation of the bridge crane on the container.

An object of the invention is to provide a crane secured to a shipping and stowage container's end to lift and move loads.

Another object of the invention is to provide a crane secured to a shipping and stowage container using standardized fittings and brackets to enable lifting and displacing loads.

Another object of the invention is to provide a crane that can be secured to the end of a shipping and stowage container without requiring ancillary heavy-lifting equipment.

Another object of the invention is to provide a bridge crane that can be quickly and securely coupled to a shipping and stowage container to raise and displace loads in X and Y directions over an area at the end of the container.

Another object of the invention is to provide a bridge crane readily connectable to the ends of single or stacked shipping containers for lifting and moving loads above peripheral areas.

Another object of the invention is to provide a bridge crane that can be quickly and securely coupled to a shipping container to lift and move loads by powered and/or manual force.

Another object of the invention is to provide a bridge crane that can be quickly secured to a shipping container with standard interfacing hardware to suspend and move loads in the area adjacent the container.

Another object of the invention is to provide a bridge crane that can be quickly secured to a shipping container for lifting/lowering loads, extending/retracting lifted loads in the X-direction and transversely moving lifted loads in the Y-direction near the container.

These and other objects of the invention will become more readily apparent from the ensuing specification when taken in conjunction with the appended claims.

DESCRIPTION OF THE PREFERRED EMBODIMENT

Figure 1:
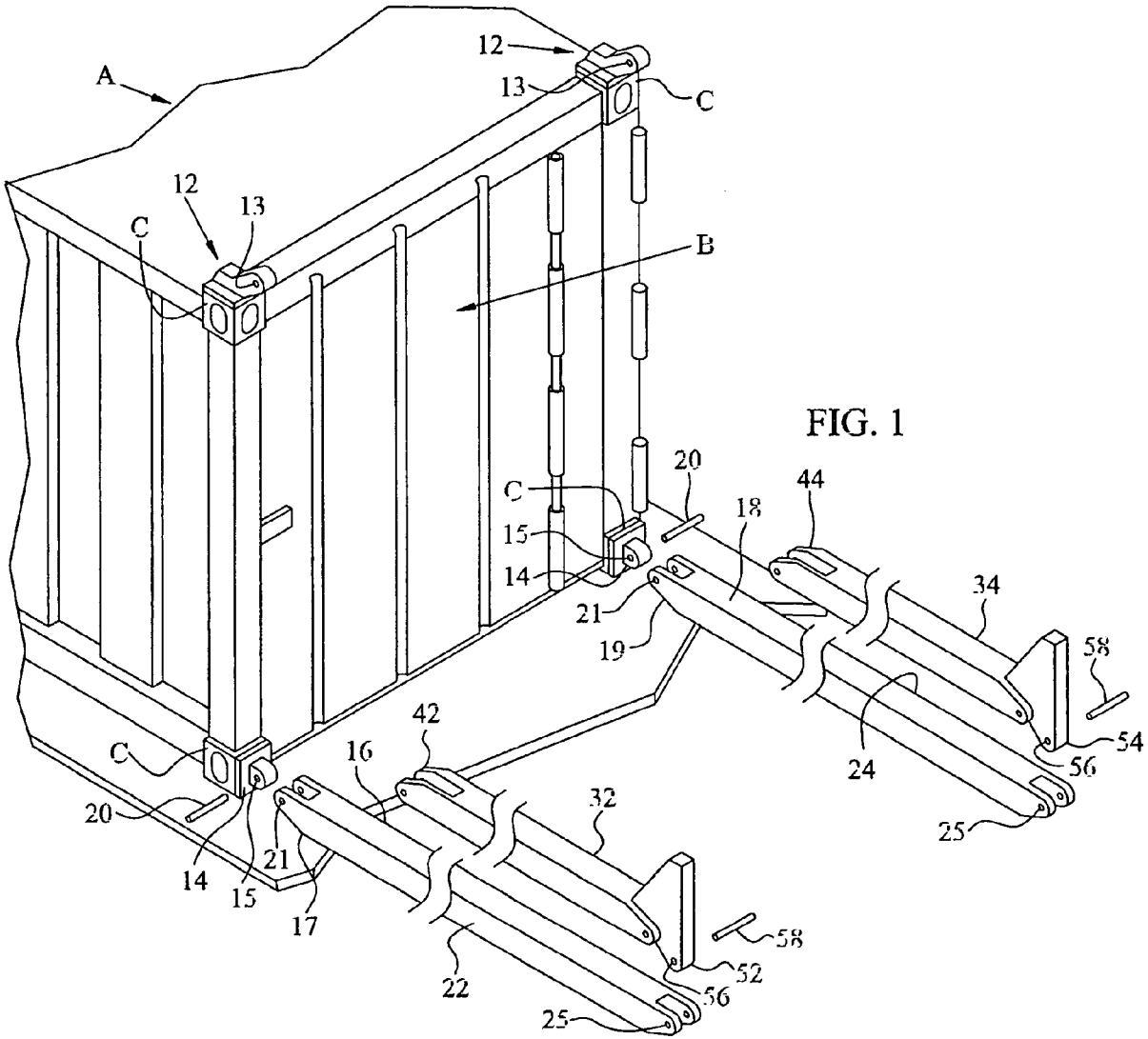
FIG. 1 is an isometric view of one end of a commercial shipping and stowage container having four block-shaped corner fittings each mounting securing brackets connectable to separated, partially shown brace members and longitudinal members of the X-Y bridge crane of the invention.
Figure 2:
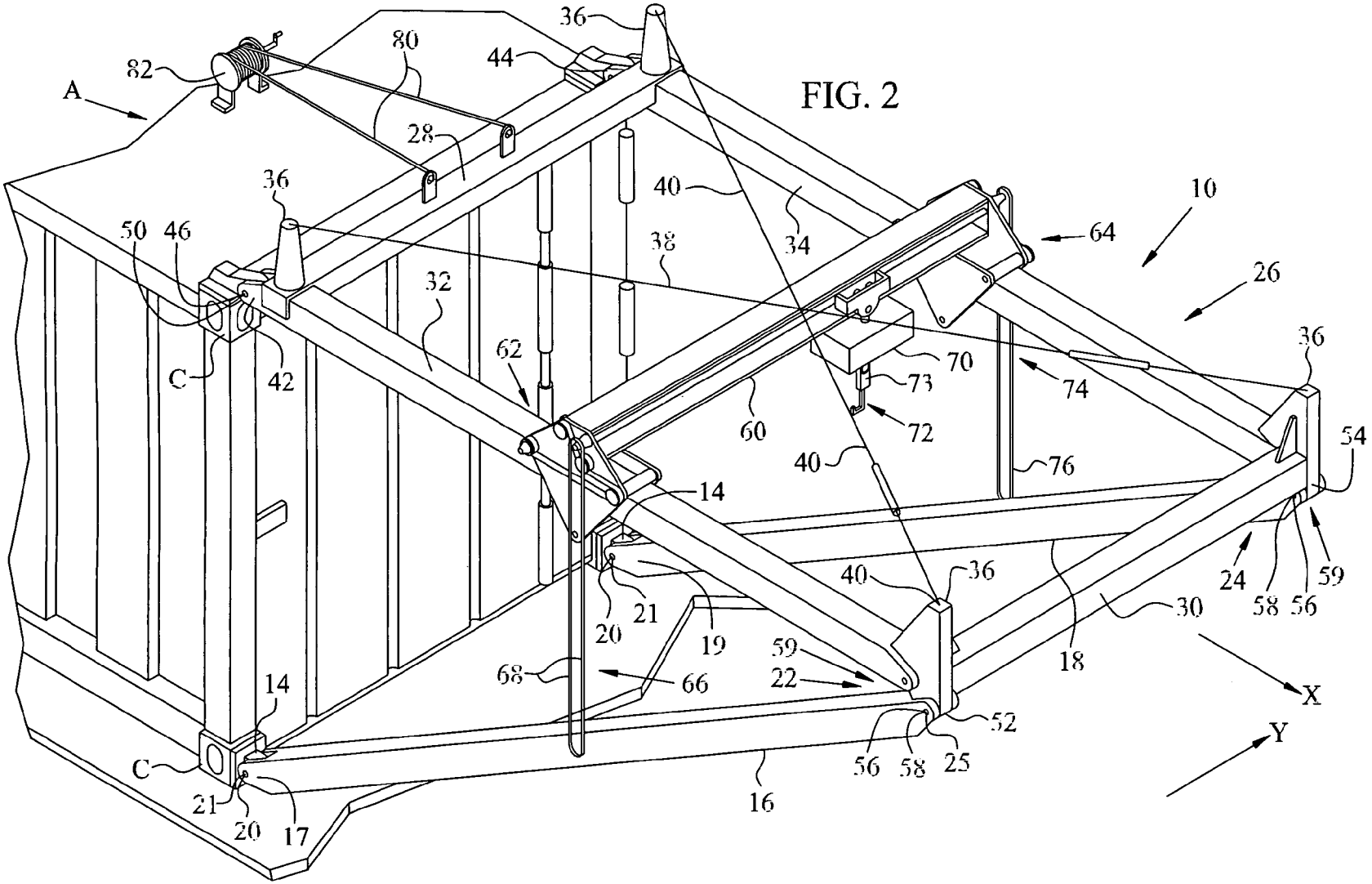
FIG. 2 is an isometric view of the X-Y bridge crane of the invention securely mounted on four block-shaped corner fittings of a commercial shipping and stowage container.

Referring to FIGS. 1 and 2, X-Y bridge crane 10 of the invention is mounted at one end of a commercial shipping and stowage container A such as an ISO 1161 shipping and stowage container, for example. Bridge crane 10 can be quickly assembled and securely attached to the end of container A by relatively unskilled workmen to provide a means to lift and move goods through doorways or openings at either end of the container. Bridge crane 10 can also be used to support goods and/or other work-pieces at the right height and lateral/longitudinal position adjacent the container's end. Only one closed door B is shown in FIG. 1, and it can be swung open and rotated 270° to an open position behind the container prior to the erection and attachment of bridge crane 10 to allow free, unimpeded transfer of goods. It is within the scope of this invention to allow appropriate modification of structural members to be described to allow opening/closing of door B while bridge crane 10 is in place.

The ISO 1161 shipping and stowage container A has a well known heavy-duty block-shaped corner fitting C at each of the containers' eight corners, only four of such corner fittings C being shown at one end. Each corner fitting C has upward, sideward and downward facing openings. In accordance with the invention, a separate rotatable top cam-lock or twist-lock securing bracket 12 is inserted into the top facing opening in each of upper ones of corner fittings C and is appropriately twisted/rotated to engage each of the two upper corner fittings C. Each top securing bracket 12 has a heavy duty upward extension having a heavy-duty pad eye 13. A separate rotatable bottom cam-lock or twist-lock securing bracket 14 is inserted into the end facing opening in each of lower ones of corner fittings C and is appropriately rotated to engage each of the two lower corner fittings C. Each bottom securing bracket 14 has a heavy duty extension having a pad eye 15. Top and bottom securing brackets 12 and 14 provide quickly attached, heavy duty mounting/anchoring points on the selected end of container A for X-Y bridge crane 10. Typically, the interfacing top cam-lock or twist lock securing brackets 12 could be proven, commercially available cam-lock container lifting lugs, model MK2A's and/or multi-function semi-automatic twist-locks model F738's, and bottom securing brackets 14 could be well known cam-lock container lifting lugs model MK5A's and/or multi-function semi-automatic twist-locks model F738's, all of which are manufactured by Peck and Hale Cargo Securing Systems. One skilled in the art could select/modify these or other commercially available units for securing brackets 12 and 14 to appropriately mount bridge crane 10 on container A.

X-Y bridge crane 10 has a pair of elongate brace members 16 and 18 each connected at inner end portions 17 and 19 to a separate one of bottom securing brackets 14. Brace members 16 and 18 are made from aluminum or steel stock or other inherently strong, tough, weight-efficient material that can support the loads of bridge crane 10 and the goods of container A. The tough material is also selected to survive the abuse to which bridge crane 10 will be subject, yet be lightweight enough to be manually transported and assembled. Brace members 16 and 18 can be tubular with a square or rectangular shape and are rotatably connected to bottom securing brackets 14 via aluminum or steel retaining bolts or pins 20 extending through a lateral hole 21 in inner end portions 17 and 19 that are respectively aligned with pad eyes 15 of bottom securing brackets 14.

Figure 3:
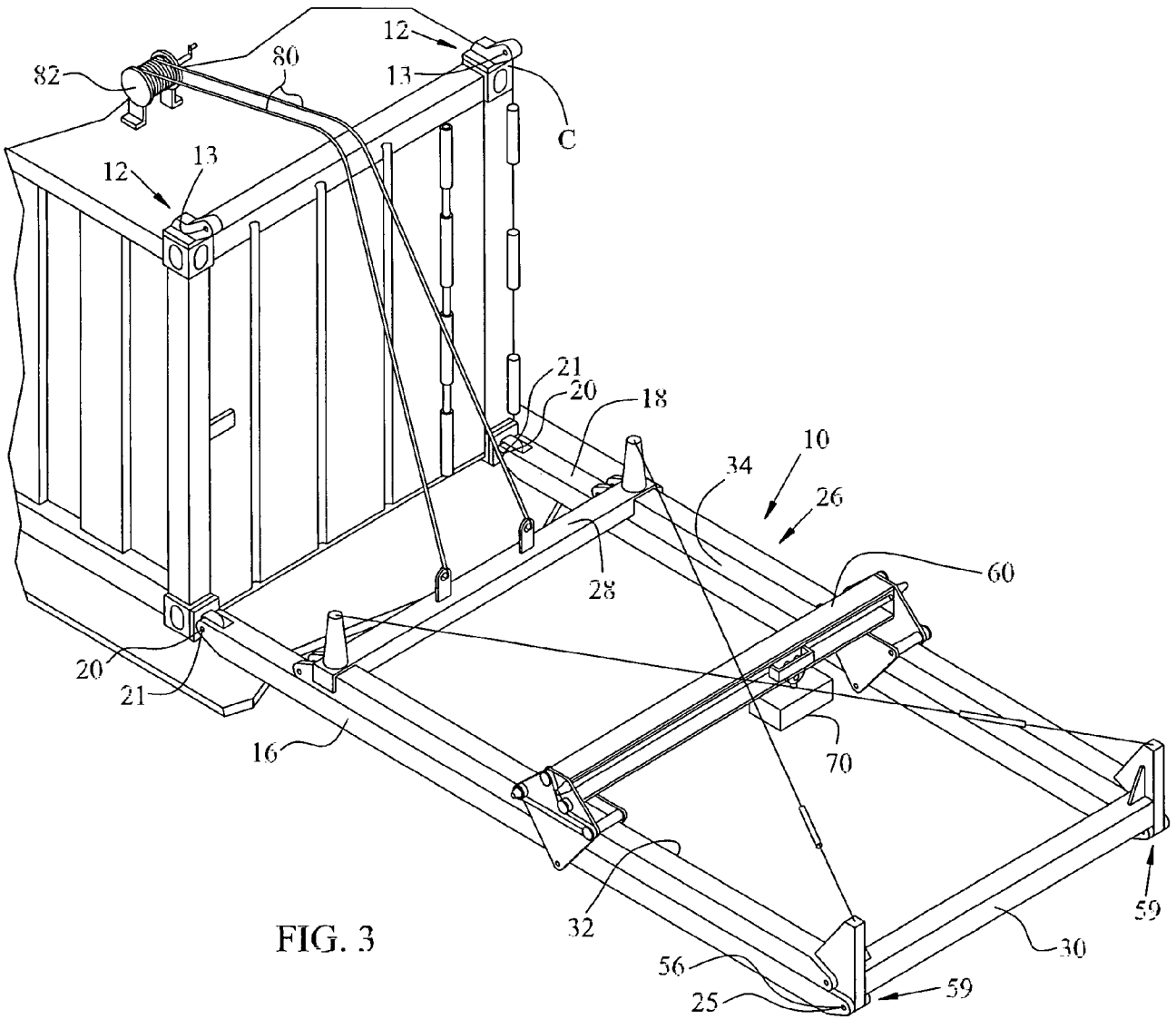
FIG. 3 is an isometric view of the X-Y bridge crane secured to elongate brace members and ready for complete installation on the end of a container.
Figure 4:
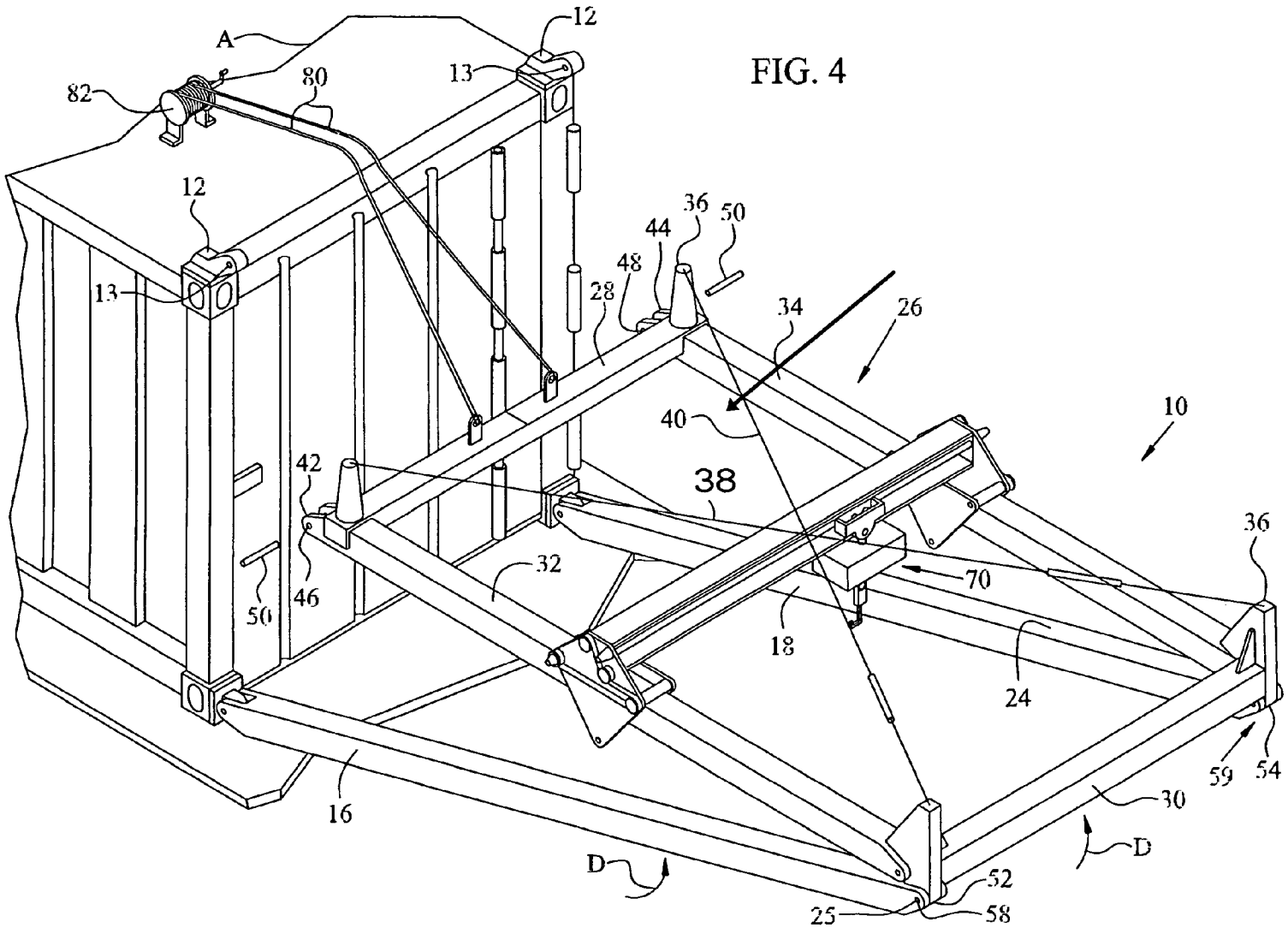
FIG. 4 is an isometric view of the X-Y bridge crane being raised and drawn-up to the end of a container by installation cables.

Referring also to FIGS. 3 and 4, elongate brace members 16 and 18 have outer end portions 22 and 24 each provided with a lateral bore 25. Brace members 16 and 18 are rotatably connected to a rectangular or square overhead framework 26 to provide partial vertical support for hoisted loads, as explained below. Framework 26 includes lateral members 28 and 30 and longitudinal members 32 and 34 that can also be made from square or rectangular-shaped strong tubular aluminum or steel stock to support the loads of bridge crane 10 and the goods of the container. Lateral members 28 and 30 and longitudinal members 32 and 34 are welded or bolted together or coupled by other means of interconnection at their opposite ends to assure strength for framework 26 to support and transfer loads in the X and Y directions near the end of the container.

An upwardly projecting cable support 36 is mounted at each of the four corners of framework 26. In the preferred embodiment shown in the figures, cable supports 36 are cone-shaped or triangular-shaped steel structures; however, the selection of the shape and material for these parts shall not be considered a limitation of the invention. The outer ends of the four cable supports 36 are secured to cable braces 38 and 40 that diagonally extend above and across framework 26 in a mutually crossing relationship. Cable braces 38 and 40 optionally can be tensioned to further assure sufficient strength to bear and transfer loads reliably.

Longitudinal members 32 and 34 of framework 26 have inner longitudinal extensions 42 and 44 having lateral openings 46 and 48 to receive a bolt or pin 50. Pins 50 are inserted through lateral openings 46 and 48 and aligned pad eyes 13 of a separate one of top securing brackets 12. The inserted pins 50 rotatably engage and complete the securing of framework 26 to container A.

Longitudinal members 32 and 34 of framework 26 also each have an outer downward projecting part 52 or 54. A lateral bore 56 in each of outer downward projecting parts 52 and 54 is placed in an aligned position with respect to a separate lateral bore 25 in each of outer end portions 22 and 24 of brace members 16 and 18. Bolts or pins 58 are inserted through the aligned bores 56 and 25 to pivotally secure elongate brace members 16 and 18 at hinge points 59 to framework 26 of bridge crane 10 and provide strong supportive structure for bridge crane 10 and the expected loads, see also FIG. 1. Framework 26, brace members 16 and 18, and other components to be described are preferably designed and made from materials to keep weight within reasonable limits to permit manual assembly and erection of bridge crane 10 by workmen at a work site without powered lifts and other crane structures.

Bridge crane 10 has a hoist-traveling beam 60 reaching across framework 26. Hoist traveling beam 60 has multi-wheel roller assemblies 62 and 64 mounted on its opposite ends to support and allow it to ride on the upper surfaces of longitudinal members 32 and 34 between lateral members 28 and 30 of framework 26. By way of example, two Series 635, Model 3575 Low Headroom Multi-wheeled Roller Trolleys, manufactured by Columbus McKinnon Corporation, 140 John James Parkway, Amherst, N.J. 14228, could be as suitable roller assemblies 62 and 64. Many other roller assemblies for supporting and moving work pieces and other loads in machine shops and assembly-lines are well known, and one skilled in the art can pick and choose suitable units from many proven designs with the exercise of ordinary skill.

Roller assemblies 62 and 64 and beam 60 can be displaced longitudinally inwardly or outwardly in the X-direction (as illustrated by the "x" arrow in FIG. 2) on longitudinal members 32 and 34 between lateral members 28 and 30 by a first linear displacement mechanism such as a first chainfall 66 connected to one end of beam 60. First chainfall 66 also is well known in the machine shop and assembly-line arts and can have a downwardly hanging closed-loop chain 68. Chain 68 is connected to interacting gears manually displaced in either rotational direction by a workman to move beam 60 in either linear direction and locate it on longitudinal members 32 and 34.

A hoist 70 is carried on hoist-traveling beam 60 to engage, raise, lower and move loads of goods on a hook 72. Hoist 70 is shaped to bidirectionally laterally ride on the length of hoist traveling beam 60 between longitudinal members 32 and 34 in the Y-direction (illustrated by the "Y" arrow in FIG. 2). Hoist 70 has appropriately interconnected and operator-controllable electric motor/pneumatic/hydraulic/manual means (not shown) to effect raising and lowering of loads coupled to hook 72 via a cable 73. Cable 73 is selectively extended and reeled-in from hoist 70 under the control of a workman at the work site. A second linear displacement mechanism, a second chainfall 74, can be mounted at the other end of beam 60. Second chainfall 74 allows a workman to selectively displace hoist 70 in opposite lateral displacements in the Y-direction on beam 60. These displacements are orthogonal to the X-directional displacements of hoist 70 by first chainfall 66.

Chainfall 74 produces such displacements of hoist 70 by any of a number of well known mechanical linkages. An exemplary second chainfall 74 might have an elongate threaded structure (not shown) that extends the length of beam 60 and threadably or otherwise engages a mating part on hoist 70 as is well known in the art. Selectively bidirectionally rotating either the mating part or the threaded structure by an interconnected downward hanging closed-loop chain 76 of second chainfall 74 can selectively displace hoist 70 in either lateral direction along beam 60 and position it where it is needed. This exemplary structure associated with second chainfall 74 is only one of a number of well known means for effecting such linear displacements from rotational displacement of chainfall 74 by chain 76. It is in the purview of one of ordinary skill to select other effective mechanical arrangements that may include small controlled motor-driven mechanisms and other appropriately interconnected and operator-controllable electric motor/pneumatic/hydraulic/manual mechanisms/assemblies to produce bidirectional displacements of hoist 70 and traveling beam 60.

Hoist 70 can be a well known commercially available powered unit connectable to an electrical power source and operated by a relatively untrained workman. A typical hoist unit that could be used is a Model 3505 Lodestar Electric Two-Speed 1 ton hoist coupled with a Model 3677 Suspension and Model 3575 Low Headroom Trolley, all manufactured by Columbus McKinnon Corporation, 140 John James Parkway, Amherst, N.J. 14228, to raise, support and lower loads along the length of hoist traveling beam 60. Other readily available models could be selected depending on the expected loads, power availabilities, and other considerations of the work site. Furthermore, instead of first and second chainfall 66 and 74, the movers of beam 60 and hoist 70 in the X-direction and of hoist 70 in the Y-direction could be mechanically coupled and electrically powered motors with controls.

The expedient manual assembly and erection of X-Y bridge crane 10 of the invention at the end of container A are some of its most obvious advantageous features. The uncomplicated structure enables quick and efficient loading or unloading of goods at container A. Assembly of X-Y bridge crane 10 requires no other power machinery and it can be installed in sections to reduce the overall weight and size of hardware that needs to be moved at any given time. Additionally, X-Y bridge crane 10 can be erected without elaborate, powered heavy-lifting equipment.

Referring once again to FIGS. 1 and 2, assembly and mounting of bridge crane 10 requires that container A has conventional upper and lower heavy duty corner fittings C at its end around door B. Top securing brackets 12 and lower securing brackets 14 are inserted and secured in appropriate ones of corner fittings C by workmen to present two outward exposed top pad eyes 13 and two bottom pad eyes 15.

Referring to FIG. 1 and FIG. 3, inner portions 17 and 19 of elongate brace members 16 and 18 are placed to align their holes 21 with openings of pad eyes 15 and bolts or pins 20 are inserted through them to rotatably secure brace members 16 and 18 to container A. Hinge points 59 at the outer end portions 22 and 24 of brace members 16 and 18 rotatably connect brace members 16 and 18 to framework 26. The other components of bridge crane 10 can be laid on top of brace members 16 and 18 at this stage of assembly and erection. Door B can be swung open and rotated 270° to an open position behind container A prior to further erection of bridge crane 10 so that goods can be transferred. Optionally, brace members 16 and 18 could be differently shaped to allow opening of door B after bridge crane 10 has been more completely assembled and mounted on the end of container A. A further option is that brace members 16 and 18, framework 26 and the other components can be pre-assembled in other combinations, or they could be brought as separate pieces or smaller subassemblies for ease of transport to the work site for complete, final assembly.

FIG. 3 shows the connected parts of X-Y bridge crane 10 rotatably mounted on container A and extending away from its end. Installation cables 80 are connected at one end to lateral member 28 and extend up over the end of the container. Installation cables 80 optionally could be extended to reach around the outside surfaces of top securing brackets 12 to help guide bridge crane 10 toward the end of container A.

The opposite ends of installation cables 80 are connected to a winch 82 schematically depicted as mounted on a suitable hard point on container A, or another solid mounting place at or near the container also can be used to mount winch 82, if desired. Winch 82 can be a manually powered unit like those used on small boat trailers to haul-in and secure a small boat, or winch 82 could be a motor-powered unit. In either case, winch 82 is operated by a workman to rotate and reel-in cables 80.

As the tightened installation cables 80 are being reeled in, brace members 16 and 18, framework 26, hoist 70 and the remaining components of bridge crane 10 are raised up and drawn up in the arrow direction D above the ground and toward the end of container A, see FIG. 4. Further reeling in of cables 80 on winch 82 brings openings 46 and 48 into alignment with pad eyes 13 of top securing brackets 12. Insertion of bolts or pins 50 (see aligned, non-inserted pins 50 in FIG. 4) through the aligned parts completes the secure mounting/installation of X-Y bridge crane 10 on corner fittings C of container A as shown in FIG. 2.

Chainfalls 66 and 74 are actuated to move the hoist-traveling beam 60 and hoist 70 in the X-direction (longitudinally) and hoist 70 in the Y-direction (laterally). The choice of acme screws, gear driven wheels, or other manually operated structure to move the beam 60 and hoist 70 are for illustrative purposes only and should not be construed as a limitation of the present invention. One skilled in the art could use many well known motor-driven powered subassemblies for moving beam 60 and hoist 70 as well.

X-Y bridge crane 10 can advantageously access the contents of container A under work conditions where no overhead or portable crane capability exists, and bridge crane 10 can be readily erected under these conditions in minimum time by relatively unskilled workmen. The X-Y movement capability of bridge crane 10 provides users the ability to move and place payloads over a large area at the end of container A. The longitudinal members 32 and 34 and cables 38 and 40 of framework 26 increase strength and stability for greater lifting capacity as compared to a single-armed crane. Bridge crane 10 also advantageously utilizes the inherent structural integrity of the shipping and mobilization container A for transverse and longitudinal rigidity and strength, and bridge crane 10 further augments its strength by attaching directly to ISO corner fittings C on the container.

All components of X-Y bridge crane 10 can be made from a wide variety of tough non-corrosive or corrosion resistant materials to survive in harsh environments. Modifications and alternate embodiments of X-Y bridge crane 10 may be adapted for other containers and other applications.

The disclosed components and their arrangements as disclosed herein, all contribute to the novel features of this invention. X-Y bridge crane 10 of the invention gives relatively unskilled workmen the capability to effectively load and unload containers in confined storage areas. Therefore, X-Y bridge crane 10 of the invention, as disclosed herein is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

We claim:

1. An apparatus for lifting and moving loads at the end of a shipping and stowage container having block-shaped corner fittings at top corners and bottom corners at its end comprising:

a pair of top securing brackets each engaging the top block-shaped corner fittings;

a pair of bottom securing brackets engaging the bottom block-shaped corner fittings;

a pair of brace members having inner and outer end portions, said inner end portions being rotatably connected to said pair of bottom securing brackets;

a rectangular framework having inner extensions and outer projecting parts and a laterally extending hoist-traveling beam, said inner extensions being connected to said pair of top securing brackets and said outer projecting parts being connected to said outer end portions of said brace members;

a hoist mounted on said hoist-traveling beam for lifting and moving loads;

a first displacement mechanism coupled to said hoist for linearly displacing said hoist in a longitudinal direction; and a second displacement mechanism coupled to said hoist for linearly displacing said hoist in a lateral direction.

2. The apparatus of claim 1 wherein said framework includes:

a pair of longitudinal members extending outward from said container;

a pair of lateral members coupled to said longitudinal members; and a pair of cable braces each connected at opposite ends to upward projecting cable supports at the ends of each of said longitudinal members at the four corners of said framework, said cable braces diagonally extending above and across said framework in a mutually crossing relationship.

3. The apparatus of claim 2 further comprising:

multi-wheeled roller assemblies mounted on opposite ends of said hoist traveling beam, wherein each said roller assembly is movably coupled to a separate one of said longitudinal members.

4. The apparatus of claim 3 wherein said first and second displacement assemblies are a first and second chainfall each having a downwardly hanging closed-loop chain manually displaced in either rotational direction to produce displacements of said hoist in the longitudinal and lateral directions.

5. The apparatus of claim 3 further comprising:

a hook and cable on said hoist to engage, raise and lower loads, said hoist having means to selectively reel said cable in and out.

6. The apparatus of claim 5 further comprising:

a winch mounted on the container; and at least one installation cable extending from said winch and coupled to one of said lateral members for hoisting said framework into position on the container.

7. The method of mounting a bridge crane on a shipping and stowage container having block-shaped corner fittings at top corners and bottom corners at its end and lifting and moving loads at the end of the container comprising:

engaging each top block-shaped corner fitting with a top securing bracket;

engaging each bottom block-shaped corner fitting with a bottom securing bracket;

rotatably connecting inner end portions of a pair of brace members having inner and outer end portions to said rotatable bottom securing brackets;

connecting outer projecting parts of a rectangular framework having inner extensions and outer projecting parts to said outer end portions of said brace members;

movably mounting a laterally extending hoist traveling beam to said framework;

movably mounting a hoist to said hoist traveling beam;

mounting a winch on the container;

connecting installation cables from said winch to a part of said framework;

reeling in said installation cables with said winch to raise said brace members and said framework above the ground and to draw said framework toward the end of the container; and connecting said inner extensions of said framework to said pair of top securing brackets.

8. The method according to claim 7 further including the steps of:

mounting a first displacement mechanism on said hoist-traveling beam to displace said hoist; and mounting a second displacement mechanism on said hoist-traveling beam to displace said hoist and said hoist-traveling beam.

9. The method according to claim 8 further comprising the steps of:

extending a pair of cables diagonally above and across said framework in a mutually crossing relationship; and connecting opposite ends of said pair of cable braces at opposite ends to upward projecting cable supports at the four corners of said framework.

10. The method according to claim 9 further comprising the steps of:

lifting a load with said hoist; and linearly displacing said hoist in longitudinal and lateral directions by said first and second displacement mechanisms.

* * * * *